US011014392B2

(12) United States Patent
Okuda et al.

(10) Patent No.: US 11,014,392 B2
(45) Date of Patent: May 25, 2021

(54) RECORDING METHOD AND RECORDING APPARATUS

(71) Applicant: Seiko Epson Corporation, Tokyo (JP)

(72) Inventors: Ippei Okuda, Shiojiri (JP); Mitsuaki Kosaka, Minowa (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/506,109

(22) Filed: Jul. 9, 2019

(65) Prior Publication Data

US 2019/0329579 A1 Oct. 31, 2019

Related U.S. Application Data

(63) Continuation of application No. 15/096,558, filed on Apr. 12, 2016, now Pat. No. 10,391,802.

(30) Foreign Application Priority Data

Apr. 14, 2015 (JP) ..... JP2015-082317

(51) Int. Cl.
*B41J 2/15* (2006.01)
*B41M 5/00* (2006.01)

(52) U.S. Cl.
CPC ..... *B41M 5/0017* (2013.01); *B41M 5/0047* (2013.01); *B41M 5/0064* (2013.01)

(58) Field of Classification Search
None
See application file for complete search history.

(56) References Cited

U.S. PATENT DOCUMENTS 5,498,222 A 3/1996 Hur
6,027,210 A 2/2000 Kurabayashi et al.
6,361,155 B1 * 3/2002 Kanda ..... B41J 2/14274 347/65

(Continued)

FOREIGN PATENT DOCUMENTS

JP H10-095107 A 4/1998
JP 2001-001627 A 1/2001

(Continued)

OTHER PUBLICATIONS

Osamu Machida and Eiichi Toyama: "Development of GEN3E1 Ink Jet Head for Industrial Application"; Design & Development Division 1, Ricoh Printing Systems, Ltd.; Ricoh Technical Report No. 33; pp. 176-180; Dec. 2007 (17 pages).

*Primary Examiner* — Erica S Lin
*Assistant Examiner* — Tracey M McMillion
(74) *Attorney, Agent, or Firm* — Harness, Dickey & Pierce, P.L.C.

(57) ABSTRACT

According to the invention, there is provided a recording method which includes adhering an ink composition to a recording medium, and adhering a reaction liquid to the recording medium, the reaction liquid containing water and a reagent for aggregating or thickening components of the ink composition, and having a pH of 7 to 10. In the adhering of the reaction liquid, an epoxy-based adhesive is used for at least a portion of a reaction liquid passage for supplying the reaction liquid to an ink jet head, and a member in contact with the reaction liquid in the ink jet head, and the reaction liquid is discharged from the ink jet head so as to adhere to the recording medium.

25 Claims, 3 Drawing Sheets

(56) References Cited

U.S. PATENT DOCUMENTS

| | | | | |
|---|---|---|---|---|
| 6,419,352 | B1 | 7/2002 | Kubota et al. | |
| 6,498,222 | B1 | 12/2002 | Kitamura et al. | |
| 8,691,004 | B2 | 4/2014 | Tahara et al. | |
| 2002/0044185 | A1 | 4/2002 | Koitabashi et al. | |
| 2003/0067525 | A1 | 4/2003 | Goto et al. | |
| 2009/0084311 | A1* | 4/2009 | Yoshida | B41J 2/0057 118/46 |
| 2009/0258203 | A1 | 10/2009 | Aoyama et al. | |
| 2011/0242201 | A1 | 10/2011 | Kato et al. | |
| 2011/0242243 | A1* | 10/2011 | Miyabayashi | B41J 11/002 347/102 |
| 2012/0223988 | A1 | 9/2012 | Matsuura | |
| 2012/0234484 | A1 | 9/2012 | Takada | |
| 2013/0115431 | A1 | 5/2013 | Aoyama et al. | |
| 2015/0091974 | A1* | 4/2015 | Aoyama | C09D 11/54 347/21 |

FOREIGN PATENT DOCUMENTS

| | | | | | |
|---|---|---|---|---|---|
| JP | 2002-137376 | A | | 5/2002 | |
| JP | 2003-039809 | A | | 2/2003 | |
| JP | 2003-326829 | A | | 11/2003 | |
| JP | 2004-122472 | A | | 4/2004 | |
| JP | 2005001342 | A | * | 1/2005 | |
| JP | 2009-248468 | A | | 10/2009 | |
| JP | 2009-262549 | A | | 11/2009 | |
| JP | 2010023265 | A | * | 2/2010 | B41M 5/0017 |
| JP | 2010-274561 | A | | 12/2010 | |
| JP | 2011-126031 | A | | 6/2011 | |
| JP | 2012179800 | A | * | 9/2012 | B41J 2/14209 |
| JP | 2012-232418 | A | | 11/2012 | |
| JP | 2014-065249 | A | | 4/2014 | |
| JP | 2014-076620 | A | | 5/2014 | |
| JP | 2015-227003 | A | | 12/2015 | |

* cited by examiner

RECORDING METHOD AND RECORDING APPARATUS

CROSS-REFERENCE TO RELATED APPLICATIONS

This application is a continuation of U.S. patent application Ser. No. 15/096,558, filed Apr. 12, 2016, which claims priority to Japanese Patent Application No. 2015-082317, filed Apr. 14, 2015, both of which are hereby expressly incorporated by reference herein in their entireties.

BACKGROUND

1. Technical Field

The present invention relates to a recording method and a recording apparatus for performing the recording method.

2. Related Art

In the related art, an ink jet recording method in which an image is recorded on a recording medium by discharging a fine ink droplet from a nozzle of a recording head of an ink jet recording apparatus has been known. As an ink jet recording ink, an ink in which a colorant such as a dye or a pigment is dissolved or dispersed in an aqueous medium which contains water, an organic solvent, or the like is generally used. The ink jet recording ink is roughly classified into a dye ink and a pigment ink. The dye ink is obtained by mixing a dye as the colorant. The pigment ink is obtained by mixing a pigment as the colorant. Thus far, a dye ink which is excellent in color reproducibility, discharge stability or the like has been widely used. However, a use of an ink jet recording technology is expanding to a digital photographic service, commercial printing, or the like, and thus long-term preservability of a recorded image becomes important, and a pigment ink which is more excellent in water resistance or light resistance, than a dye ink has been used.

However, if recording of a recording medium such as plain paper, coated paper, and art paper is performed by using the pigment ink as the ink jet recording ink, the pigment is permeated into the medium, and thus there is a problem of causing the optical density to be easily insufficient.

To solve the above problem, for example, JP-A-2010-274561 discloses an ink jet recording method in which a reaction liquid which is different from a pigment ink and contains water and a pigment cohesive agent is prepared, and a recording region of a recording medium is coated with a pretreatment liquid in advance, prior to ink jet recording by using the pigment ink. JP-A-2010-274561 discloses that an alkali metal halide, and an organic acid such as succinic acid and acetic acid may be used as the pigment cohesive agent.

JP-A-2003-326829 discloses an ink jet recording method in which a recording surface is coated with a reaction liquid which has a pigment ink aggregation function and a film formation function, and then a pigment ink is discharged so as to record an image, and a film is formed on the recording surface by heating and drying. JP-A-2003-326829 discloses that a multivalent metal salt may be used as a pigment cohesive agent.

If a recording medium is allowed to be coated with the reaction liquid as disclosed in JP-A-2010-274561 and JP-A-2003-326829 from an ink jet recording head, it is possible to easily control a coating amount or a coated region, and to easily replace an ink. Thus, it is possible to expect a big improvement in productivity.

However, coating the recording medium with such a reaction liquid from the ink jet recording head enables the improvement of optical density of an image, but new problems occur in that an epoxy-based adhesive used in bonding of an ink passage member in the head is deteriorated, and head durability is degraded.

In a case where a line type head is used as the ink jet recording head, the reaction liquid floats in the ink jet recording apparatus in a form of ink mist, and thus corrosion may occur in the apparatus.

SUMMARY

An advantage of some aspects of the invention is to provide a recording method which includes a process of discharging a reaction liquid from an ink jet recording head, and is excellent in durability for an ink jet recording apparatus. Further, an advantage of some aspects of the invention is to provide a recording method which is excellent in head durability for a long term in addition to being excellent in durability for an ink jet recording apparatus, and can record an image having excellent image quality and durability.

The invention can be realized in the following aspects or application examples.

Application Example 1

According to an aspect of the invention, there is provided a recording method which includes adhering an ink composition to a recording medium, and adhering a reaction liquid to the recording medium, the reaction liquid containing water and a reagent for aggregating or thickening components of the ink composition, and having a pH of 7 to 10. In the adhering of the reaction liquid, an epoxy-based adhesive is used for at least a portion of a reaction liquid passage for supplying the reaction liquid to an ink jet head, and a member in contact with the reaction liquid in the ink jet head, and the reaction liquid is discharged from the ink jet head so as to adhere to the recording medium.

According to the recording method of Application Example 1, the pH of the reaction liquid which contains the reagent and water is set to be from 7 to 10, and thus it is possible to suppress deterioration of an epoxy-based adhesive used in bonding of a passage member for the reaction liquid in the head, and to improve durability of the head.

Application Example 2

According to another aspect of the invention, there is provided a recording method which includes adhering an ink composition to a recording medium, and adhering a reaction liquid to the recording medium, the reaction liquid containing water and a reagent for aggregating or thickening components of the ink composition, and having a pH of 7 to 10. In the adhering of the reaction liquid, adhering is performed by discharging the reaction liquid from a line type ink jet head.

According to the recording method of Application Example 2, the pH of the reaction liquid which contains the reagent and water is set to be from 7 to 10, and thus it is possible to suppress occurrence of corrosion in an ink jet recording apparatus even when the reaction liquid floats in the ink jet recording apparatus in a form of ink mist.

Application Example 3

In the recording method according to Application Example 1 or Application Example 2, surface tension of the reaction liquid may be from 18 mN/m to 35 mN/m at 20° C.

Application Example 4

In the recording method according to any one of Application Examples 1 to 3, concentration of the reagent in the reaction liquid may be from 0.05 mol/L to 0.9 mol/L.

Application Example 5

In the recording method according to any one of Application Examples 1 to 4, viscosity of the reaction liquid may be from 2 mPa·s to 10 mPa·s at 20° C.

Application Example 6

In the recording method according to any one of Application Examples 1 to 5, in the reaction liquid adhering process, a mass of one droplet (1 dot) of the discharged reaction liquid may be equal to or smaller than 10 ng/dot.

Application Example 7

In the recording method according to any one of Application Examples 2 to 6, a scanning speed in the reaction liquid adhering process may be equal to or higher than 5 m/minute.

Application Example 8

In the recording method according to any one of Application Examples 1 to 7, adhering of the ink composition may be started within 20 seconds from when adhering of the reaction liquid is completed.

Application Example 9

In the recording method according to any one of Application Examples 1 to 8, the reagent may be a multivalent metal salt and a salt of strong acid and alkali.

Application Example 10

According to still another aspect of the invention, there is provided a recording apparatus which is used for performing the recording method according to any one of Application Examples 1 to 9, and includes an ink jet head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
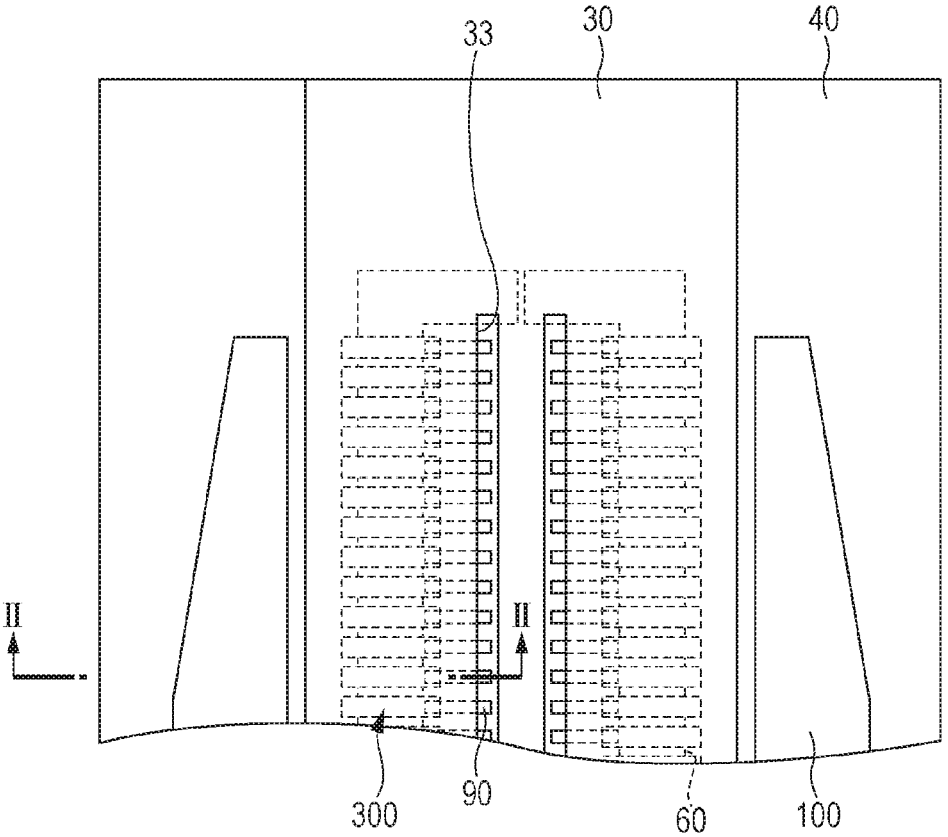
FIG. 1 is a schematic plan view illustrating an ink jet head used in a first embodiment.

Hereinafter, preferred embodiments will be described. The embodiments which will be described below are used for describing an example of the invention. The invention is not limited to the following embodiments and may include various modification examples conducted in a range without deviating from the gist of the invention. In each of a first embodiment and a second embodiment which will be described later, regarding constituents other than constituents which are particularly required for the corresponding embodiment, the constituents of the first embodiment and the second embodiment may be alternately used.

1. RECORDING METHOD

1.1. First Embodiment

According to a first embodiment, there is provided a recording method including an ink composition adhering process and a reaction liquid adhering process. In the ink composition adhering process, an ink composition is adhered to a recording medium. In the reaction liquid adhering process, a reaction liquid is adhered to the recording medium. The reaction liquid contains water and a reagent for aggregating or thickening components of the ink composition, and has a pH of 7 to 10. In the reaction liquid adhering process, an epoxy-based adhesive is used for at least a portion of a reaction liquid passage for supplying the reaction liquid to an ink jet head, and a member of contact with the reaction liquid in the ink jet head, and the reaction liquid is discharged from the ink jet head so as to adhere to the recording medium.

In the invention, "an image" indicates a recorded pattern which is formed from a dot group, and includes a text print and a solid image. The "solid image" means a solid image pattern. The solid image pattern is an image in which dots are recorded in all pixels (which is the smallest recording unit region defined by recording resolution), and a recording region of a recording medium is covered with an ink so as to cause the ground of the recording medium not to be viewed.

The recording method according to the embodiment will be described below in detail for each of the processes thereof.

1.1.1. Reaction Liquid Adhering Process 1.1.1.1. Description for Processes

In the reaction liquid adhering process, a reaction liquid containing a reagent for aggregation or thickening of an ink composition is discharged from an ink jet head so as to adhere to a recording region of a recording medium. When the reagent is adhered to the recording region of a recording medium in advance, if the reagent and the ink composition are brought into contact with each other, a component (for example, colorant or resin) contained in the ink composition, and the reagent react with each other. If the reaction is performed, a state where the colorant or the resin is dispersed in the ink composition is disturbed, and thus the colorant or the resin is aggregated or the ink composition is thickened. Accordingly, it is considered that it is possible to impede permeation of the colorant into the recording medium, and thus the process is excellent from a point of improvement of image quality of a recorded image.

In the reaction liquid adhering process according to the first embodiment, an epoxy-based adhesive is used for at least a portion of a reaction liquid passage for supplying the reaction liquid to an ink jet head, and a member of contact with the reaction liquid in the ink jet head, and the reaction liquid is discharged from the ink jet head so as to adhere to the recording medium. A recording medium is coated with the reaction liquid from an ink jet recording head, and thus it is possible to easily control a coating amount of the reaction liquid and to control a coated region, and to easily replace an ink. Thus, it is possible to expect big improvement of productivity. Regarding the reaction liquid used in this embodiment, a pH of the reaction liquid containing the reagent and water is set to be from 7 to 10. If such a reaction liquid is used, it is possible to suppress deterioration of the epoxy-based adhesive used in bonding of a passage member for the reaction liquid in the ink jet head, and to improve durability of the ink jet head.

Configuration of Ink Jet Head

Figure 2:
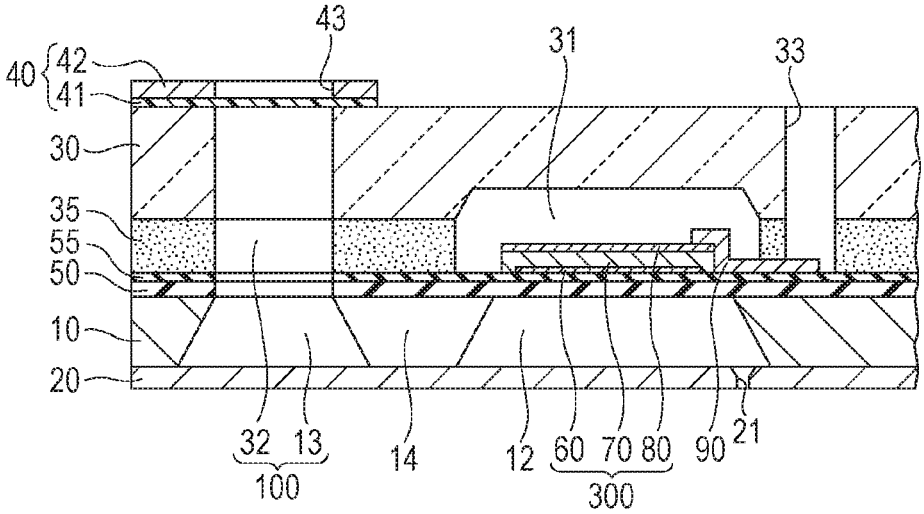
FIG. 2 is a schematic cross-sectional view illustrating an ink jet head used in the first embodiment.

An example of a structure of the ink jet head used in the first embodiment will be described below with reference to the drawings. FIG. 1 is a plan view illustrating the ink jet head which is used in the first embodiment. FIG. 2 is a cross-sectional view taken along line II-II in FIG. 1. A passage formation board 10 is formed from a silicon single crystal substrate having a plane orientation (110). As illustrated in FIG. 1, an elastic film 50 is formed on one surface of the passage formation board 10. The elastic film 50 is formed of silicon dioxide and is 0.5 μm to 2 μm in thickness. Two columns in which a plurality of pressure generation chambers 12 is arranged in a width direction of the pressure generation chambers 12 are provided in the passage formation board 10. A communication portion 13 is formed on the outside of each of the columns of the pressure generation chambers 12 in the passage formation board 10. The communication portion 13 and each of the pressure generation chambers 12 communicate with each other through an ink supply path 14. The ink supply path 14 is formed so as to have a width narrower than that of the pressure generation chamber 12. The communication portion 13 communicates with a reservoir portion of a reservoir formation board so as to constitute a portion of a reservoir which functions as a common ink chamber for the pressure generation chambers 12. The ink supply path 14 holds passage resistance of an ink flowing into the pressure generation chamber 12 from the communication portion 13 to be constant.

A nozzle plate 20 is fixed on a surface of the passage formation board 10 on an opposite side of the elastic film 50 through an adhesive or a heat welding film. A nozzle opening 21 which performs communication in the vicinity of an end portion of each of the pressure generation chambers 12 on an opposite side of the ink supply path 14 is bored in the nozzle plate 20. The nozzle plate 20 is formed from, for example, glass, ceramics, silicon single crystal plate, stainless steel (SUS). For example, the nozzle plate 20 is formed from stainless steel in the ink jet head used in the embodiment.

As described above, the elastic film 50 which is, for example, about 1.0 μm in thickness is formed on an opposite side of an opening surface of such a passage formation board 10. An insulating film 55 which is formed of zirconium oxide ($ZrO_2$) and is, for example, about 0.4 μm in thickness is formed on the elastic film 50. Further, a lower electrode film 60, a piezoelectric layer 70, and an upper electrode film 80 are stacked and formed on the insulating film 55 through processes (which will be described later), so as to form a piezoelectric element 300. The lower electrode film 60 is formed of platinum (Pt) and iridium (Ir), and is, for example, about 0.2 μm in thickness. The piezoelectric layer 70 is formed of lead zirconate titanate (PZT) and is, for example, about 1.0 μm in thickness. The upper electrode film 80 is formed of iridium (Ir), and is, for example, about 0.05 μm in thickness.

Here, the piezoelectric element 300 refers to a portion which includes the lower electrode film 60, the piezoelectric layer 70, and the upper electrode film 80. Generally, a configuration in which any one electrode of the piezoelectric element 300 is set to be a common electrode, and another electrode and the piezoelectric layer 70 are patterned for each of the pressure generation chambers 12 is made. In this embodiment, the lower electrode film 60 is set to be the common electrode of the piezoelectric element 300, and the upper electrode film 80 is set to be an individual electrode of the piezoelectric element 300. However, there is no problem even when the above setting is reversed in accordance with circumstances of a driving circuit or wiring. A lead electrode 90 is connected to the upper electrode film 80 which corresponds to the individual electrode of the piezoelectric element 300 and a voltage is applied to each piezoelectric element 300 through the lead electrode 90.

Here, in this embodiment, the lower electrode film 60 which corresponds to the common electrode of the piezoelectric element 300 is formed in a region facing the pressure generation chamber 12 in a longitudinal direction of the pressure generation chamber 12, and plural lower electrode film 60 are continuously provided in a region corresponding to a plurality of pressure generation chambers 12, in a juxtaposed direction of the pressure generation chambers 12. The lower electrode film 60 is provided so as to be extended to the outside of the series of the pressure generation chambers 12 in the juxtaposed direction of the pressure generation chambers 12. In this embodiment, the lower electrode films 60 are continuously provided around a plurality of piezoelectric elements 300 and lead electrodes 90 which are provided in parallel. Such lower electrode films 60 are formed in each of the series of the pressure generation chambers 12. The piezoelectric layer 70 and the upper electrode film 80 which constitute the piezoelectric element 300 are basically provided in a region facing the pressure generation chamber 12. However, the piezoelectric layer 70 and the upper electrode film 80 are provided so as to be extended to the outside of the end portion of the lower electrode film 60 in the longitudinal direction of the pressure generation chamber 12.

A protective board 30 which is an example of a bonding substrate is bonded to a surface on the piezoelectric element 300 side of the passage formation board 10. The protective board 30 includes a piezoelectric element holding portion 31 for protecting the piezoelectric element 300. The piezoelectric element 300 is protected in a state where an influence of an external environment is hardly received because of being formed in the piezoelectric element holding portion 31. The piezoelectric element holding portion 31 may or may not be air-tightly sealed. A reservoir portion 32 is provided in a region of the protective board 30, which corresponds to the communication portion 13 of the passage formation board 10. In this embodiment, the reservoir portion 32 is provided in the juxtaposed direction of the pressure generation chamber 12 so as to penetrate the protective board 30 in a thickness direction thereof. The reservoir portion 32 communicates with the communication portion 13 of the passage formation board 10, as described above, so as to constitute a reservoir 100 which functions as the common ink chamber of the pressure generation chambers 12. An exposure hole 33 is formed in the central region of the protective board 30, that is, a region of the piezoelectric element holding portion 31 on an opposite side of the reservoir portion 32. The exposure hole 33 is penetrated in the thickness direction so as to expose the lead electrode 90 and the lower electrode film 60. Although not illustrated, a driving IC mounted on the protective board 30 is electrically connected to the lead electrode 90 and the lower electrode film 60 by using a connection wire which is provided so as to be extended in the exposure hole 33.

Examples of a material of such a protective board 30 include glass, ceramics, metal, and a resin. However, the protective board 30 is preferably formed by using a material having substantially the same thermal expansion coefficient as the passage formation board 10. The protective board 30 is bonded to the passage formation board 10 by an adhesive layer 35 which is formed from an epoxy-based adhesive. If the passage formation board 10 and the protective board 30 are bonded to each other by using the epoxy-based adhesive, an adhesive force is excellent and head capacity is maintained even when the head is used for a long term. Using the epoxy-based adhesive has excellent head rigidity and is also excellent from a point of easily stabilizing discharge characteristics, for example. If a member attack property of the adhesive layer 35 is deteriorated, it is predicted that members swell due to a use of the head for a long period, and swelling of the members causes fluctuation of a discharged amount.

In this embodiment, the epoxy-based adhesive is used for the adhesive layer 35 which is used in bonding of the passage formation board 10 and the protective board 30 to each other. However, using of the epoxy-based adhesive is not limited to members in the head. It is predicted that similar effects are exhibited from a point that, for example, leakage of the reaction liquid is also prevented without peeling of the members in a case where bonding is performed similarly in an ink passage from an ink accommodation member to the head, by using epoxy-based adhesive.

The epoxy-based adhesive is not limited to the following materials. As the epoxy-based adhesive, for example, the conventional well-known adhesives in which a main agent containing a compound which has an epoxy group is cured by a curing agent are exemplified. The compound which is contained in the main agent and has an epoxy group is not limited to the following materials. Examples of such a compound include bisphenol type epoxy of a bisphenol A type, a bisphenol F type, and the like, novolak type epoxy of a phenol novolak type, a cresol novolak type, and the like, epoxy polyol type epoxy, urethane-modified epoxy, chelate-modified epoxy, and rubber-modified epoxy. The curing agent is not limited to the following materials. Examples of the curing agent include amines such as amine and polyamine, acid anhydride, amides such as amide and polyamide, imidazoles, and polymercaptan. Among the above materials, for an excellent adhesive force, a combination of bisphenol type epoxy as the main agent and amines as the curing agent is preferable. A mixing ratio (main agent:curing agent) of the main agent and the curing agent is preferably 10:1 to 1:10 in mass conversion, in order to be excellent in curing properties of the adhesive.

A compliance board 40 which is configured by a sealing film 41 and a fixation plate 42 is bonded onto the protective board 30. The sealing film 41 is formed of a material (for example, polyphenylene sulfide (PPS) film having a thickness of 6 μm) which has flexibility and low rigidity. One surface of the reservoir portion 32 is sealed by the sealing film 41. The fixation plate 42 is formed of a hard material (for example, stainless steel (SUS) having a thickness of 30 μm, and the like) such as metal. A region of the fixation plate 42, which faces the reservoir portion 32 functions as an opening portion 43 of which the region is completely removed in a thickness direction of the fixation plate 42. Thus, the one surface of the reservoir portion 32 is sealed only by the sealing film 41 which has flexibility.

In such an ink jet head, an ink is put from an external ink supply section (not illustrated), and the inside of the head from the reservoir 100 to the nozzle opening 21 is filled with the ink. Then, a voltage is applied between the lower electrode film 60 and the upper electrode film 80 which correspond to each of the pressure generation chambers 12, in accordance with a recording signal from the driving IC (not illustrated) which is mounted on the protective board 30. Thus, the elastic film 50, the insulating film 55, the lower electrode film 60, and the piezoelectric layer 70 are bent and deformed, and thus pressure in each of the pressure generation chambers 12 is increased. Accordingly, ink droplets are discharged from the nozzle opening 21.

Recording Medium

In the embodiment, the recording medium which is a printing target is not particularly limited. However, recording on an ink low-absorbable or ink non-absorbable recording medium is preferable.

In this specification, "an ink non-absorbable or ink low-absorbable recording medium" indicates a recording medium having properties in which any portion of an ink composition is not absorbed or the ink composition is hardly absorbed. Quantitatively, the ink non-absorbable or ink low-absorbable recording medium indicates "a recording medium in which an absorbed water amount from a start of contact until 30 $msec^{1/2}$, in the Bristow method is equal to or smaller than 10 $mL/m^2$". The Bristow method is a method which is used most widely as a measuring method of a liquid absorbing amount for a short term. The Bristow method is employed in Japan Technical Association of the Pulp and Paper Industry (JAPAN TAPPI). Details of a test method are described in "Paper and board—Test of water absorptiveness—Bristow method" Standard No. 51 of "Paper and Pulp test method, JAPAN TAPPI, 2000". An ink absorbable recording medium indicates a recording medium which does not correspond to the ink non-absorbable or ink low-absorbable recording medium.

Examples of the ink non-absorbable recording medium include a plastic film in which an ink absorptive layer is not provided, a medium in which a base such as paper is coated with plastics, a medium to which a plastic film is attached. Examples of plastics referred herein include polyvinyl chloride, polyethylene terephthalate, polycarbonate, polystyrene, polyurethane, polyethylene, and polypropylene.

As the ink low-absorbable recording medium, a recording medium in which a coating layer for accepting an ink is provided on a surface is exemplified. For example, a printing paper such as art paper, coated paper, and matted paper is exemplified as a medium in which paper is provided as a base. In a case where a plastic film is used as a base, a medium in which a surface of polyvinyl chloride, polyethylene terephthalate, polycarbonate, polystyrene, polyurethane, polyethylene, polypropylene, and the like is coated with hydrophilic polymer, a medium in which particles of silica, titanium, and the like are coated along with a binder, and the like are exemplified.

Recording Conditions

When the reaction liquid is adhered to the recording medium from the ink jet head, droplets are preferably adhered to the recording medium at resolution of 600×600 dpi or greater. Adhering is preferably performed with a droplet amount of 30 ng/dot or smaller, more preferably 20 ng/dot or smaller, further preferably 15 ng/dot or smaller, and further more preferably 10 ng/dot smaller. A lower limit of the droplet amount is not limited, but is preferably equal to or greater than 1 ng/dot. Adhering of the reaction liquid is performed under such recording conditions, and thus uniform adhering can be performed even when adhering of the reaction liquid is performed with a small adhering amount. Thus, such recording conditions are preferable.

The maximum adhering amount of the reaction liquid to the recording region is preferably from 0.2 mg/inch$^2$ to 2 mg/inch$^2$, and more preferably from 0.5 mg/inch$^2$ to 2 mg/inch$^2$. Since the reaction liquid can be caused to uniformly adhere to the recording region from the ink jet head even when the maximum adhering amount of the reaction liquid to the recording region is small as in the above range, it is possible to sufficiently disturb a state (where the colorant or the resin is dispersed) of the ink composition which adhere to the recording region in the ink composition adhering process (which will be described later). In addition, a case where the minimum adhering amount of the reaction liquid to the recording region is also in the above range is more preferable from a point of exhibition of the above effects.

Others

In order to improve wettability of the reaction liquid for the recording medium before the reaction liquid adhering process, a surface modification process of performing surface modification on the recording medium may be performed. For example, the surface modification is performed so as to cause the wet tension index of the surface of an ink non-absorbable or ink low-absorbable recording medium to be equal to or greater than 40 mN/m. Thus, it is possible to improve wet spreadability of the reaction liquid and to cause the reaction liquid to uniformly adhere to the recording medium. Here, the "wet tension index" is an index of wet tension measured based on "Plastics-Film and Sheeting-Test of Wetting Tension (JIS K6768:1999)".

Such a surface modification process is not particularly limited. For example, a corona treatment, an atmospheric pressure plasma treatment, a flame treatment, an ultraviolet radiation treatment, a solvent treatment, an adhering treatment of a resin liquid (for example, a primer treatment), and the like are exemplified. These treatment methods may be performed by using a well-known apparatus.

A drying process after the reaction liquid adhering process may be included. In the drying process, the reaction liquid which is adhered to the recording region of the recording medium is dried. In this case, drying is preferably performed to an extent of not feeling stickiness when contact with the reaction liquid adhered to the recording region of the recording medium occurs. The drying process of the reaction liquid may be performed in a manner of air drying, or performed in a manner of drying with heating. A heating method of the reaction liquid is not particularly limited. However, for example, a heat press method, a normal pressure steam method, a high pressure steam method, a thermo-fixed method, and the like are exemplified. As a heat source for heating, for example, an infrared ray (lamp) is exemplified.

1.1.1.2. Reaction Liquid

Next, a reaction liquid used in the reaction liquid adhering process will be described. The reaction liquid used in the embodiment contains a reagent for aggregation or thickening of the ink composition (which will be described later), and other components. Components contained in the reaction liquid which is used in the embodiment, and components which may be contained will be described below in detail.

Reagent

The reaction liquid used in this embodiment contains a reagent which reacts with a component (for example, colorant or resin) contained in the ink composition so as to cause aggregation or thickening. Examples of the reagent include a multivalent metal salt, organic acid, and a cationic compound (cationic resin, cationic surfactant, and the like). The reagent may be singly used or used in combination of two or more types. Among the reagents, from a viewpoint of excellent reactivity with the resin contained in the ink composition, the multivalent metal salt is preferable. In this embodiment, descriptions relating the multivalent metal salt as the reagent may be applied as a reagent which is not limited to the multivalent metal salt.

As the multivalent metal salt, a compound which is configured from a multivalent (bivalent or more) metal ion and an anion bonded to the multivalent metal ion, and is soluble in water may be used. Anhydride or hydrate may be used. Specific examples of the multivalent metal ion include bivalent metal ions such as $Ca^{2+}$, $Cu^{2+}$, $Ni^{2+}$, $Mg^{2+}$, $Zn^{2+}$, and $Ba^{2+}$; and trivalent metal ions such as $Al^{3+}$, $Fe^{3+}$, and $Cr^{3+}$. Examples of the anion include $Cl^-$, $I^-$, $Br^-$, $SO_4^{2-}$, $ClO^{3-}$, $NO^{3-}$, $HCOO^-$, and $CH_3COO^-$.

A material which indicates alkalinity itself is included in the above-exemplified multivalent metal salts. However, even when such a multivalent metal salt is used, an appropriate pH is preferably obtained by using a pH adjuster (which will be described later). Among the above-exemplified multivalent metal salts, a material which indicates acidity itself in the above-exemplified multivalent metal salts is preferable. That is, a multivalent metal salt having a pH which is smaller than 7 is preferably used in a case where the pH adjuster is not used in the reaction liquid. Using such a multivalent metal salt causes reactivity as the reagent to be improved, causes image quality of a recorded image to become more excellent, and causes odor to become relatively small. Examples of such multivalent metal salts include salts of strong acid and alkali, specifically, nitrate (calcium nitrate, magnesium nitrate, and the like), sulfates (calcium sulfate, magnesium sulfate, and the like), and hydrochloride salts. Salts of weak acid and alkali, such as formate and acetate may be also used.

Examples of organic acid desirably include sulfuric acid, hydrochloric acid, nitric acid, phosphoric acid, polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid; derivatives of the above compounds; and salts of the above materials. The organic acid may be singly used or be used in combination of two or more types.

Examples of the cationic resin include a cationic urethane resin, a cationic olefin resin, and a cationic allylamine resin.

As the cationic urethane resin, well-known materials may be appropriately selected and used. As the cationic urethane resin, a commercial product may be used. For example, the following materials may be used: Hydran CP-7010, CP-7020, CP-7030, CP-7040, CP-7050, CP-7060, and CP-7610 (merchandise name, manufactured by DIC Corporation); Superflex 600, 610, 620, 630, 640, and 650 (merchandise name, manufactured by DKS Co., Ltd.); and urethane emulsion WBR-2120C and WBR-2122C (merchandise name, manufactured by Taisei Fine Chemical Co., Ltd.).

The cationic olefin resin has olefin such as ethylene and propylene, as a structure skeleton. As the cationic olefin resin, well-known materials may be appropriately selected and used. The cationic olefin resin may be in an emulsion state of being dispersed in a solvent which includes water, an organic solvent, or the like. As the cationic olefin resin, a commercial product may be used. For example, Arrow Base CB-1200 and CD-1200 (merchandise name, manufactured by Unitika Ltd.) are exemplified.

As the cationic allylamine resin, well-known materials may be appropriately selected and used. Examples of the cationic allylamine resin may include polyallylamine hydrochloride, polyallylamine amide sulfate, allylamine hydrochloride.diallylamine hydrochloride copolymers, allylamine acetate.diallylamine acetate copolymers, allylamine hydrochloride.dimethylallylamine hydrochloride copolymers, allylamine.dimethylallylamine copolymers, polydiallylamine hydrochloride, polymethyl diallyl amine hydrochloride, polymethyl diallyl amine amide sulfate, polymethyl diallyl amine acetate, polydiallyl dimethylammonium chloride, diallylamine acetate.sulfur dioxide copolymer, diallyl methylethyl ammonium ethyl sulfate.sulfur dioxide copolymers, methyl diallyl amine hydrochloride.sulfur dioxide copolymer, diallyl dimethyl ammonium chloride.sulfur dioxide copolymers, and diallyldimethyl ammonium chloride.acrylamide copolymer. As such a cationic allylamine-based resin, a commercial product may be used. For example, the following commercial products may be used: PAA-HCL-01, PAA-HCL-03, PAA-HCL-05, PAA-HCL-3L, PAA-HCL-10L, PAA-H-HCL, PAA-SA, PAA-01, PAA-03, PAA-05, PAA-08, PAA-15, PAA-15C, PAA-25, PAA-H-10C, PAA-D11-HCL, PAA-D41-HCL, PAA-D19-HCL, PAS-21CL, PAS-M-1L, PAS-M-1, PAS-22SA, PAS-M-1A, PAS-H-1L, PAS-H-5L, PAS-H-10L, PAS-92, PAS-92A, PAS-J-81L, and PAS-J-81 (merchandise name, manufactured by Nittobo Medical Co., Ltd.), Hymo Neo-600, Hymoloc Q-101, Q-311, and Q-501, and Hymacs SC-505 and SC-505 (merchandise name, manufactured by Hymo Co., Ltd.).

Examples of the cationic surfactant include primary amine salt-type compounds, secondary amine salt-type compounds, and tertiary amine salt-type compounds, alkyl amine salts, dialkyl amine salts, aliphatic amine salts, benzalkonium salts, quaternary ammonium salts, quaternary alkylammonium salts, alkyl pyridinium salts, sulfonium salts, phosphonium salts, onium salts, and imidazolinium salts. Specific examples of the cationic surfactant include hydrochloride such as laurylamine, Yashiamine, and rosin amine, acetates, lauryl trimethyl ammonium chloride, cetyl trimethyl ammonium chloride, benzyl tributyl ammonium chloride, benzalkonium chloride, dimethyl ethyl lauryl ammonium ethyl sulfate, dimethyl ethyl octyl ammonium ethyl sulfate, trimethyllauryl ammonium hydrochloride, cetyl pyridinium chloride, cetyl pyridinium bromide, dihydroxyethyl lauryl amine, decyl dimethyl benzyl ammonium chloride, dodecyl dimethyl benzyl ammonium chloride, tetradecyl dimethyl ammonium chloride, hexadecyl dimethyl ammonium chloride, and octadecyl dimethyl ammonium chloride.

The content of the reagent may be appropriately determined so as to exhibit the above-described effects. For example, the content of the reagent in 1 L of a reaction liquid is preferably from 0.05 mol/L to 1.0 mol/L, more preferably from 0.1 mol/L to 0.9 mol/L, and particularly preferably from 0.3 mol/L to 0.8 mol/L. If the content of the reagent is in the above range, the reagent adhering to the recording region and the component in the ink composition sufficiently react with each other, and aggregation or thickening of the ink composition is caused. Thus, printing quality (image quality or image durability) of a record tends to be good. The content of the reagent is, for example, preferably from 0.5 mass % to 25 mass %, and more preferably from 1 mass % to 20 mass %, with respect to the total mass of the reaction liquid.

Water

The reaction liquid used in the embodiment preferably uses water as the main solvent. The water is a component which adheres the reaction liquid to the recording region of the recording medium, and then is dried so as to be evaporated and scattered. As the water, pure water or ultra-pure water such as ion exchange water, ultrafiltration water, reverse osmotic water, and distilled water, that is, water in which ionic impurities are removed as much as possible is preferable. If water sterilized by ultraviolet ray radiation, addition of hydrogen peroxide, or the like is used, generation of mold or bacteria in a case where the reaction liquid is stored for a long term can be prevented. Thus, such water is desired. The content of the water contained in the reaction liquid may be set to be, for example, equal to or greater than 50 mass %, with respect to the total mass of the reaction liquid.

Organic Solvent

An organic solvent may be added to the reaction liquid used in the embodiment. It is possible to improve wettability of the reaction liquid to the recording medium by adding the organic solvent. As the organic solvent, a solvent similar to an organic solvent exemplified in an ink composition (which will be described later) may be used. The content of the organic solvent is not particularly limited. However, the content of the organic solvent may be set to be, for example, from 1 mass % to 40 mass %, with respect to the total mass of the reaction liquid.

Surfactant

A surfactant may be added to the reaction liquid used in the embodiment. It is possible to reduce surface tension of the reaction liquid, and to improve wettability for the recording medium by adding the surfactant. Among surfactants, for example, an acetylene glycol-based surfactant, a silicon-based surfactant, and a fluorine-based surfactant may be preferably used. As a specific example of the surfactant, a surfactant similar to a surfactant exemplified in the ink composition (which will be described later) may be used. The content of the surfactant is not particularly limited. However, the content of the surfactant may be set to be, for example, from 0.1 mass % to 1.5 mass %, with respect to the total mass of the reaction liquid.

pH Adjuster

A pH of the reaction liquid used in this embodiment is from 7 to 10, preferably from 7.5 to 9, and more preferably from 8 to 9. If the pH of the reaction liquid is in the above range, it is understood that a member attack property by using the reaction liquid is good and head capacity is held regardless of a long-term use, in a case where an epoxy-based adhesive is used in bonding of a member in the ink jet head. If the pH of the reaction liquid is out of the above range, the member attack property by using the reaction liquid is deteriorated in a case where the epoxy-based adhesive is used in bonding of a member in the ink jet head. If the member attack property by using the reaction liquid is deteriorated, it is predicted that the member in the ink jet head swells by a long-term use of the ink jet head and swelling of the member causes fluctuation of a discharged amount.

In a case where other adhesive (for example, silicone adhesive and the like) is used in bonding of the member in the ink jet head, for example, the member attack property is good, but the head durability may be deteriorated when the head is used for a long period. As the reason, reasons, for example, that peeling causes the head durability to be deteriorated and causes stable discharge to be difficult, other than swelling are predicted.

A pH of the reaction liquid used in this embodiment may be adjusted so as to be from 7 to 10, by using the pH adjuster, as described above. The pH adjuster is not particularly limited, but a pH adjuster which can adjust the pH of being neutral to be in a range of alkalinity may be used. Examples of such a pH adjuster include sodium hydroxide, potassium hydroxide, calcium hydroxide, sodium carbonate, ammonia, triethanol amine, and triisopropanol amine.

Other Components

If necessary, a corrosion inhibitor.antifungal agent, a rust inhibitor, a chelating agent, and the like may be added to the reaction liquid used in the embodiment.

1.1.2. Ink Composition Adhering Process 1.1.2.1. Descriptions for Processes

In the ink composition adhering process, an ink composition is adhered to the recording region to which the reaction liquid has adhered, after the above-described reaction liquid adhering process or simultaneously with the reaction liquid adhering process. In the ink composition adhering process, droplets of the ink composition are discharged from nozzles of an ink jet recording head, and are adhered to the above-described recording region of the recording medium, which has the reaction liquid adhering thereto, and thereby an image is recorded in the recording region. Thus, an image formed from the ink composition is formed in the recording region of the recording medium.

Adhering of the ink composition is preferably started within 30 seconds from completion of the reaction liquid adhering. The upper limit value is preferably equal to or smaller than 20 seconds, more preferably equal to or smaller than 15 seconds, further preferably equal to or smaller than 10 seconds, further more preferably equal to or smaller than 7 seconds, and particularly equal to or smaller than 5 seconds. The lower limit value is equal to or greater than 0 second, preferably equal to or greater than 0.05 seconds, more preferably equal to or greater than 0.1 seconds, further preferably equal to or greater than 0.5 seconds, and particularly preferably equal to or greater than 1 second. Adhering of the ink composition is started within 30 seconds from completion of adhering of the reaction liquid, and thus the ink composition can be adhered to the recording region of the recording medium before the reaction liquid in the recording region of the recording medium is completely dried and/or before the reaction liquid permeates the recording medium. Thus, the reagent contained in the reaction liquid, and the component contained in the ink composition may react with each other rapidly. Accordingly, it is possible to improve more the image quality of a recorded image and to increase a recording rate.

The maximum adhering amount of the ink composition to the recording region is preferably from 5 mg/inch$^2$ to 20 mg/inch$^2$, and more preferably from 5 mg/inch$^2$ to 15 mg/inch$^2$. If the maximum adhering amount of the ink composition to the recording region is in the above range, a relative ratio of the adhering amount of the reagent contained in the reaction liquid and the adhering amount of the reactive component contained in the ink composition becomes appropriate in the recording region, and the recording rate can be increased. Thus, the above range is preferable.

After the ink composition adhering process, a drying process in which the ink composition which has adhered to the recording region of the recording medium may be provided. In this case, drying is preferably performed to an extent of not feeling stickiness when contact with the ink composition adhering to the recording region of the recording medium occurs. The drying process of the ink composition may be performed in a manner of air drying. However, from a similar viewpoint to the above-described drying process of the reaction liquid, the drying process of the ink composition may be performed in a manner of drying with heating. A heating method of the ink composition is not particularly limited. However, similar methods to the methods exemplified as the above-described heating method of the reaction liquid are exemplified.

1.1.2.2. Ink Composition

Components contained in the ink composition which is used in the ink composition adhering process, and components which may be contained will be described below in detail.

Colorant

The ink composition used in the embodiment contains a colorant. From a viewpoint of easy exhibition of the effects of the invention, a pigment or an acid dye may be preferably used as the colorant.

Among pigments, as an inorganic pigment, for example, carbon black, iron oxide, and titanium oxide are exemplified. Carbon black is not particularly limited. However, examples of carbon black include furnace black, lamp black, acetylene black, and channel black (C.I. Pigment Black 7). Examples of commercial products of carbon black include carbon black No. 2300, and 900, MCF88, No. 20B, No. 33, No. 40, No. 45, and No. 52, MA7, MA8, MA100, and No. 2200B (all the above are merchandise name, manufactured by Mitsubishi Chemical Corporation), Carbon Black FW1, FW2, FW2V, FW18, FW200, S150, S160, and S170, Pritex 35, U, V, and 140U, Special Black 6, 5, 4A, 4, and 250 (all the above are merchandise name, manufactured by Degussa AG), Conductex SC, Raven 1255, 5750, 5250, 5000, 3500, 1255, and 700 (all the above are merchandise name, manufactured by Columbian Carbon Japan Ltd, and Columbian Chemicals, Regal 400R, 330R, and 660R, Mogul L, Monarch 700, 800, 880, 900, 1000, 1100, 1300, and 1400, and Elftex 12 (all the above are merchandise name, manufactured by Cabot Corporation).

Examples of an organic pigment include quinacridone-based pigments, quinacridone quinone-based pigments, dioxazine-based pigments, phthalocyanine-based pigments, anthrapyrimidine-based pigments, anthanthrone-based pigments, indanthrone-based pigments, flavanthrone-based pigments, perylene-based pigments, diketopyrrolopyrrole-based pigments, perinone-based pigments, quinophthalone-based pigments, anthraquinone-based pigments, thioindigo-based pigments, benzimidazolone-based pigments, isoindolinone-based pigments, azomethine-based pigments, and azo-based pigments. Specific examples of the organic pigment include the following materials.

Examples of a pigment used in a cyan ink include C.I. Pigment Blue 1, 2, 3, 15, and 15:1, 15:2, 15:3, 15:4, 15:6, 15:34, 16, 18, 22, 60, 65, and 66, C.I. Vat Blue 4, and 60.

Examples of a pigment used in a magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, and 264, C.I. Pigment Violet 19, 23, 32, 33, 36, 38, 43, and 50.

Examples of a pigment used in a yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213.

As pigments used in inks of other colors, such as a green ink and an orange ink, the conventional well-known pigments are exemplified. The pigment may be singly used or be used in combination of two or more types.

As the acid dye, acid dyes of azos, anthraquinones, pyrazolones, phthalocyanines, xanthenes, indigoids, triphenylmethanes and the like are exemplified. Specific examples of the acid dye include C.I. Acid Yellow 17, 23, 42, 44, 79, and 142, C.I. Acid Red 52, 80, 82, 249, 254, and 289, C.I. Acid Blue 9, 45, and 249, and C.I. Acid Black 1, 2, 24, and 94. The acid dye may be singly used or be used in combination of two or more types.

Water

The ink composition used in the embodiment preferably uses water as the main solvent. The water is a component which adheres the ink composition to the recording region of the recording medium, and then is dried so as to be evaporated and scattered. As the water, pure water or ultra-pure water such as ion exchange water, ultrafiltration water, reverse osmotic water, and distilled water, that is, water in which ionic impurities are removed as much as possible is preferable. If water sterilized by ultraviolet ray radiation, addition of hydrogen peroxide, or the like is used, generation of mold or bacteria in a case where the ink composition is stored for a long term can be prevented. Thus, such water is desired. The content of the water contained in the ink composition may be set to be, for example, equal to or greater than 50 mass %, with respect to the total mass of the ink composition.

Organic Solvent

An organic solvent may be added to the ink composition used in the embodiment. Addition of the organic solvent allows the following function to be applied to the ink: a function of improving wettability of the ink composition to the recording medium, a function of improving fixability of a recorded image to the recording medium, or a function of preventing drying of a discharge head and improving discharge stability.

The organic solvent is not particularly limited. Examples of the organic solvent include 1,2-alkane diols, polyhydric alcohols (excluding 1,2-alkane diols), pyrrolidone derivatives, and glycol ethers.

Examples of 1,2-alkane diols include 1,2-propanediol, 1,2-butanediol, 1,2-pentanediol, 1,2-hexanediol, and 1,2-octanediol. 1,2-alkane diols has excellent effects of improving the wettability of the ink composition for a recording medium and uniformly wet the recording medium. In a case where 1,2-alkane diols are contained, the content of 1,2-alkane diols may be set to be from 1 mass % to 20 mass %, with respect to the total mass of the ink composition.

Examples of polyhydric alcohols (excluding 1,2-alkane diols) include ethylene glycol, diethylene glycol, propylene glycol, dipropylene glycol, 1,3-propanediol, 1,4-butanediol, 1,6-hexanediol, trimethylol propane, glycerine. In a case where polyhydric alcohols are contained, the content of polyhydric alcohols may be set to be from 2 mass % to 30 mass %, with respect to the total mass of the ink composition.

Examples of the pyrrolidone derivatives include N-methyl-2-pyrrolidone, N-ethyl-2-pyrrolidone, N-vinyl-2-pyrrolidone, 2-pyrrolidone, N-butyl-2-pyrrolidone, and 5-methyl-2-pyrrolidone. The pyrrolidone derivatives function as a good solubilizer for the resin.

Examples of glycol ethers include ethylene glycol monoisobutyl ether, ethylene glycol monohexyl ether, ethylene glycol monoisohexyl ether, diethylene glycol monohexyl ether, triethylene glycol monohexyl ether, diethylene glycol monoisohexyl ether, triethylene glycol monoisohexyl ether, ethylene glycol mono isoheptyl ether, diethylene glycol monoisoheptyl ether, triethylene glycol monoisoheptyl ether, ethylene glycol monooctyl ether, ethylene glycol monoisooctyl ether, diethylene glycol monoisooctyl ether, triethylene glycol monoisooctyl ether, ethylene glycol mono-2-ethylhexyl ether, diethylene glycol mono-2-ethylhexyl ether, triethylene glycol mono-2-ethylhexyl ether, diethylene glycol mono-2-ethyl pentyl ether, ethylene glycol mono-2-ethyl pentyl ether, ethylene glycol mono-2-ethylhexyl ether, diethylene glycol mono-2-ethylhexyl ether, ethylene glycol mono-2-methyl pentyl ether, diethylene glycol mono-2-methyl pentyl ether, propylene glycol monobutyl ether, dipropylene glycol monobutyl ether, tripropylene glycol monobutyl ether, propylene glycol monopropyl ether, dipropylene glycol monopropyl ether, and tripropylene glycol monomethyl ether. These glycol ethers may be singly used or two or more thereof may be mixed and used. Glycol ethers may control wettability and the like of the ink composition for a recording medium.

The content of the organic solvent is not particularly limited. However, the content of the organic solvent may be set to be, for example, from 1 mass % to 40 mass %, with respect to the total mass of the ink composition.

Surfactant

The ink composition according to the embodiment may contain a surfactant. The surfactant has a function of reducing surface tension of an ink and improving wettability for the recording medium. Among surfactants, for example, an acetylene glycol-based surfactant, a silicon-based surfactant, and a fluorine-based surfactant may be preferably used.

The acetylene glycol-based surfactant is not particularly limited. Examples of the acetylene glycol-based surfactant include SURFYNOL 104, 104E, 104H, 104A, 104BC, 104DPM, 104PA, 104PG-50, 104S, 420, 440, 465, 485, SE, SE-F, 504, 61, DF37, CT111, CT121, CT131, CT136, TG, GA, and DF110D (all the above are merchandise name, manufactured by Air Products and Chemicals. Inc.), OLFIN B, Y, P, A, STG, SPC, E1004, E1010, PD-001, PD-002W, PD-003, PD-004, EXP.4001, EXP.4036, EXP.4051, AF-103, AF-104, AK-02, SK-14, and AE-3 (all the above are merchandise name, manufactured by Nissin Chemical Industry Co., Ltd.), and ACETYLENOL E00, E00P, E40, and E100 (all the above are merchandise name, manufactured by Kawaken Fine Chemicals Co., Ltd.).

The silicon-based surfactant is not particularly limited. A polysiloxane compound is preferably exemplified. The polysiloxane compound is not particularly limited, and for example, polyether-modified organosiloxane is exemplified. Examples of commercial products of polyether-modified organosiloxane include BYK-306, BYK-307, BYK-333, BYK-341, BYK-345, BYK-346, and BYK-348 (all the above are merchandise name, manufactured by BYK Corporation), KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (all the above are merchandise name, manufactured by Shin-Etsu Chemical Co., Ltd.).

As the fluorine-based surfactant, fluorine-modified polymer is preferably used. As a specific example of the fluorine-modified polymer, BYK-340 (manufactured by BYK-Chemie Japan Corporation) is exemplified.

In a case where the surfactant is contained, the content of the surfactant may be set to be from 0.1 mass % to 1.5 mass %, with respect to the total mass of the ink composition.

Resin

The ink composition according to this embodiment may contain a resin. As the resin contained in the ink composition, a resin in which the resin contained in the ink composition, and the reagent in the recording region of the recording medium react with each other, a dispersed state of the colorant or the resin in the ink composition is disturbed, and thus the colorant or the resin is aggregated or thickened is preferably used. Because it is possible to impede permeation of the colorant into the recording medium by containing such a resin, it is possible to prevent occurrence of landing interference or bleeding of the ink composition which will adhere thereafter, and to homogenously draw a line, a fine image, and the like. Thus, it is considered that the resin is excellent from a point of improving the image quality of a recorded image. The resin contained in the ink composition, and the reagent react with each other rapidly, and thus it is possible to reduce odor.

Such a resin having high reactivity is not particularly limited. However, it is preferable that (1) an anionic resin in which an anionic functional group is put into a surface is used, (2) a resin in which an acid value is equal to or greater than 5 mgKOH/g (preferably equal to or greater than 20 mgKOH/g, and more preferably equal to or greater than 40 mgKOH/g) is used, or (3) a self-dispersion resin which is not obtained without an emulsifier is used. Here, the "anionic resin" refers to a resin in which the entirety of the resin has negative charges. The "self-dispersion resin" refers to a resin which can be dispersed for itself without a need for a dispersant.

Examples of the material of the resin include an acrylic resin, a urethane resin, a polyolefin resin, a polyester resin, a vinyl acetate copolymer resin, and an ionomer resin.

As a form of the resin, a resin particle (resin emulsion) or a water-soluble resin may be used. However, from a point of the above-described effects, the resin particle (resin emulsion) is preferable.

Among the resins, the anionic resin emulsion having the anionic functional group on the surface thereof is preferable because the anionic resin emulsion can improve the reactivity more (reduce the volume relating to the reaction), and can be bonded to the reagent rapidly by electrostatic interaction. Examples of the anionic functional group include a carboxyl group, a sulfonic acid group, and a phosphoric acid group, and a group derived from the above groups.

In the specification, the "acid value" means an amount (mg) of KOH required for neutralizing a resin solid content of 1 g. The "acid value" may be measured by a method described in JIS K0070, for example, a potential-difference titration method.

From a point of sufficient reaction with the reagent, the lower limit value of the solid content of the resin is preferably equal to or greater than 0.1 mass %, more preferably equal to or greater than 0.3 mass %, and particularly preferably equal to or greater than 0.5 mass %, with respect to the total mass of the ink composition. From a point of storage stability or discharge stability of the ink composition, the upper limit value thereof is preferably equal to or smaller than 13 mass %, more preferably equal to or smaller than 10 mass %, further preferably equal to or smaller than 7 mass %, and particularly preferably equal to or smaller than 5 mass %.

Other Components

The ink composition may contain a pH adjuster, a corrosion inhibitor.antifungal agent, a rust inhibitor, a chelating agent, and the like, if necessary.

1.1.3. Physical Properties of Each of Ink Compositions

The reaction liquid and the ink composition which are used in the embodiment (also referred to as "ink compositions" in the specification) have surface tension at 20° C., which is preferably from 18 mN/m to 35 mN/m, and more preferably from 20 mN/m to 35 mN/m, from a viewpoint of balance between image quality and reliability as an ink jet recording ink. The surface tension may be measured by using, for example, an automatic surface tension measuring device CBVP-Z (merchandise name, manufactured by Kyowa Interface Science Co., Ltd.), and may be measured by confirming surface tension when a platinum plate is wet with the ink under an environment of 20° C.

From the similar viewpoint, viscosity of each of the ink compositions at 20° C., which are used in the embodiment is preferably from 2 mPa·s to 10 mPa·s, and more preferably from 2 mPa·s to 8 mPa·s. The viscosity may be measured under an environment of 20° C. by using, for example, a viscoelasticity tester MCR-300(merchandise name, manufactured by Pysica Corporation).

1.2. Second Embodiment

According to a second embodiment of the invention, there is provided a recording method including an ink composition adhering process and a reaction liquid adhering process. In the ink composition adhering process, an ink composition is adhered to a recording medium. In the reaction liquid adhering process, a reaction liquid is adhered to the recording medium. The reaction liquid contains water and a reagent for aggregating or thickening components of the ink composition, and has a pH of 7 to 10. In the reaction liquid adhering process, adhering is performed by discharging a reaction liquid from a line type ink jet head.

The recording method according to this embodiment will be described below in detail for each of the processes thereof.

1.2.1. Reaction Liquid Adhering Process

In the reaction liquid adhering process, a reaction liquid containing a reagent for aggregation or thickening of an ink composition is discharged from a line type ink jet head so as to adhere to a recording region of a recording medium. When the reagent is adhered to the recording region of a recording medium in advance, if the reagent and the ink composition are brought into contact with each other, a component (for example, colorant or resin) contained in the ink composition, and the reagent react with each other. If the reaction is performed, a state where the colorant or the resin is dispersed in the ink composition is disturbed, and thus the colorant or the resin is aggregated or the ink composition is thickened. Accordingly, it is considered that it is possible to impede permeation of the colorant into the recording medium, and thus the process is excellent from a point of improvement of image quality of a recorded image.

In the reaction liquid adhering process according to the second embodiment, the reaction liquid is discharged from the line type ink jet head so as to adhere to the recording region of the recording medium. The line type ink jet head is a head in which the length of the head in a longitudinal direction (direction intersecting with a scanning direction) is equal to or greater than the length of the recording region of the recording medium in the longitudinal direction. The recording medium is coated with the reaction liquid from the line type ink jet head, and thus it is possible to easily control a coating amount of the reaction liquid and to control a coated region. Recording is preferably performed by scanning. The scanning is performed by discharging the reaction liquid to the recording medium while a relative position of the line type ink jet head to the recording medium is changed. When recording is performed, the number of times of performing scanning for recording one image is preferably equal to or greater than 1. The upper limit of the number of times is not limited, but is preferably equal to or smaller than 20. The upper limit of the number of times is more preferably equal to or smaller than 10, further preferably equal to or smaller than 5, further more preferably equal to or smaller than 3, and particularly preferably equal to or smaller than 2. In a case where the reaction liquid is discharged to the recording medium small number of times of scanning, productivity is significantly improved. If the reaction liquid is discharged from the line type ink jet head, the number of nozzles is relatively large, and the reaction liquid floats in an ink jet recording apparatus in a form of ink mist. Thus, in a case where the reaction liquid has strong member attack property, members in the ink jet recording apparatus may be corroded. Regarding such a problem, the pH of the reaction liquid which contains a multivalent metal salt and water is set to be from 7 to 10. Thus, it is apparent that it is possible to suppress corrosion of the members in the ink jet recording apparatus even when the reaction liquid floats in the ink jet recording apparatus in a form of ink mist.

In the reaction liquid adhering process according to the second embodiment, the scanning speed of the reaction liquid adhering process is preferably equal to or greater than 5 m/minute. The upper limit of the scanning speed is not particularly limited. However, the scanning speed is preferably equal to or smaller than 50 m/minute, more preferably equal to or smaller than 40 m/minute, further preferably equal to or smaller than 30 m/minute, particularly preferably equal to or smaller than 20 m/minute, further more preferably equal to or smaller than 15 m/minute. The scanning speed of the reaction liquid adhering process is equal to or greater than 5 m/minute, and thus the recording rate becomes faster and the mist is easily generated. However, according to the recording method of the second embodiment, even when the mist is generated, it is possible to suppress corrosion of the members in the ink jet recording apparatus. Thus, the second embodiment is preferable from a point of improving productivity and suppressing occurrence of in-apparatus corrosion.

Ink Jet Recording Apparatus Including Line Type Ink Jet Head

Figure 3:
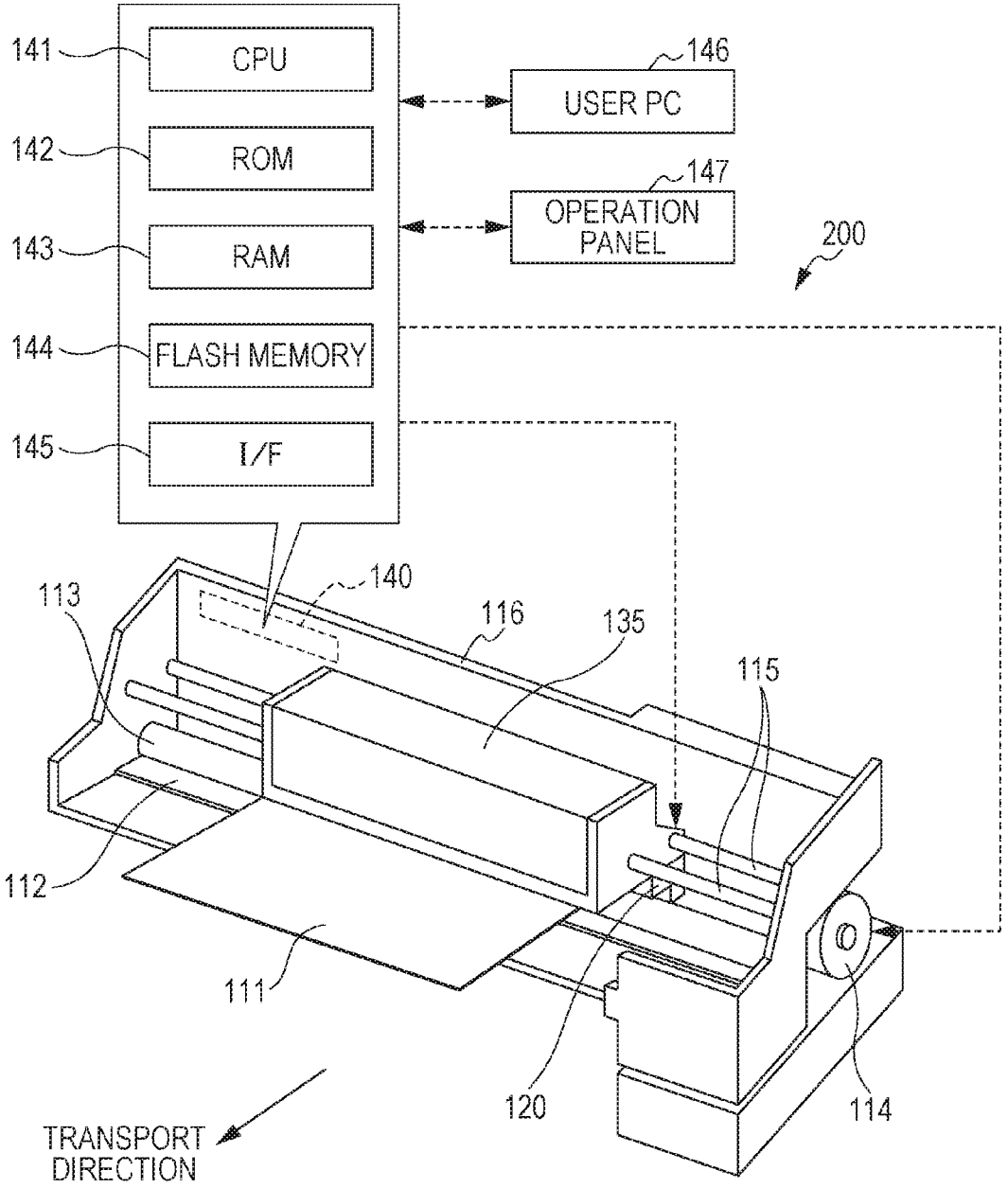
FIG. 3 is a schematic diagram illustrating an ink jet recording apparatus which includes a line type ink jet head used in a second embodiment.

An example of an ink jet recording apparatus including the line type ink jet head which is used in the second embodiment will be described below with reference to the drawings. FIG. 3 is a schematic diagram illustrating a configuration of the ink jet recording apparatus including the line type ink jet head which is used in the second embodiment.

As illustrated in FIG. 3, an ink jet recording apparatus 200 includes a transporting roller 113, a step motor 114, a line head 120, a vibration element (not illustrated), an ink cartridge 135, and a controller 140. The transporting roller 113 transports a recording medium 111 onto a platen 112. The step motor 114 rotationally drives the transporting roller 113. The line head 120 is attached to enable moving in a direction perpendicular to a transporting direction (direction indicated by an arrow in FIG. 3) of the recording medium 111 by a guide rail 115. The line head 120 discharges ink droplets to the transported recording medium 111. The vibration element vibrates the line head 120 in the direction perpendicular to the transporting direction of the recording medium 111. The controller 140 controls the entirety of the apparatus.

The vibration element is formed, for example, by a piezoelectric element (electrostrictive vibrator) such as PZT. The vibration element is attached to the line head 120. Thus, the line head 120 may be vibrated along the guide rail 115 in the direction perpendicular to the transporting direction of the recording medium 111, by vibrating the vibration element. Vibrating in the perpendicular direction is not necessary.

The controller 140 is configured as a microprocessor which has a CPU 141 as the center. The controller 140 includes a ROM 142, a RAM 143, a flash memory 144, an interface (I/F) 145, and input and output ports (not illustrated), in addition to the CPU 141. The ROM 142 stores various processing programs. The RAM 143 temporarily stores data. The flash memory 144 enables writing and deleting of data. The interface (I/F) 145 performs communication of information with an external device.

A printing buffer area is provided in the RAM 143. Printing data which is received from a user PC 146 through the interface (I/F) 145 may be stored in the printing buffer area. Various operation signals and the like are input to the controller 140 from an operation panel 147 through the input port. A driving signal for the line head 120, a driving signal for the step motor 114, an output signal for the operation panel 147, and the like are output from the controller 140 through the output port.

The operation panel 147 is a device which receives an input of various instructions from a user and displays and outputs a status of the apparatus. Although not illustrated, a display for displaying characters, figures, and marks corresponding to various instructions, buttons for causing a user to perform various operations, or the like is provided in the operation panel 147.

Figure 4:
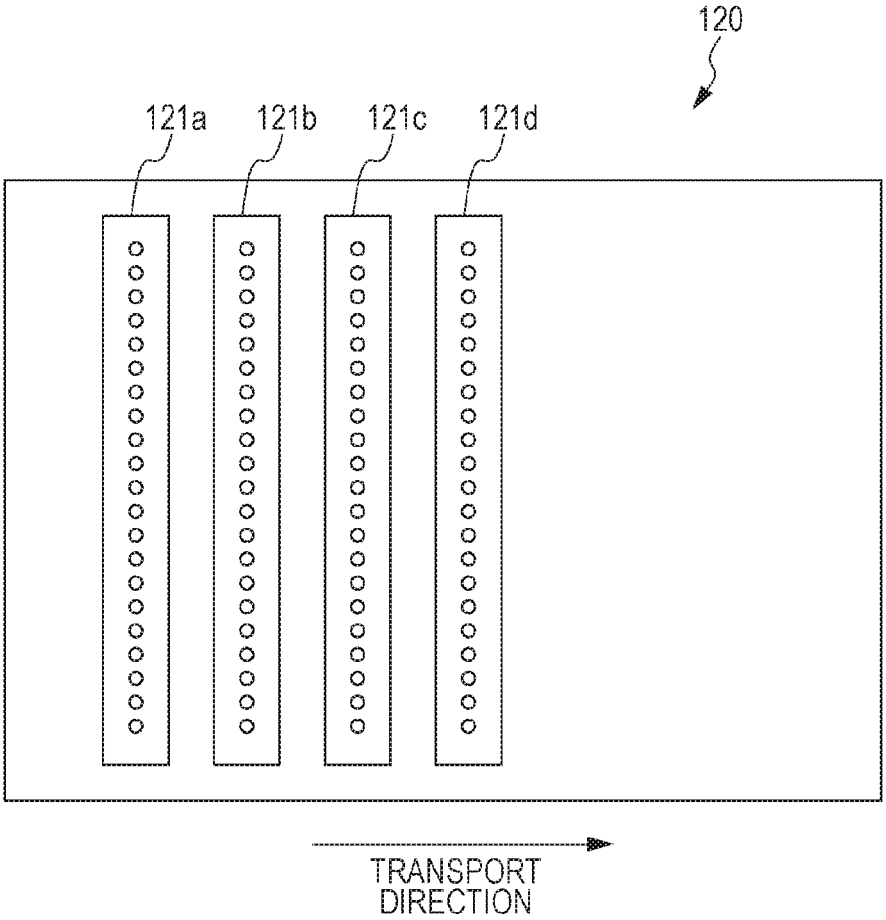
FIG. 4 is a schematic plan view illustrating a line type ink jet head used in the second embodiment.

FIG. 4 is a schematic plan view illustrating a structure of the line head. As illustrated in FIG. 4, the line head 120 includes nozzle rows 121*a*, 121*b*, 121*c*, and 121*d*. In the nozzle row, a plurality of nozzles is arranged in the direction perpendicular to the transporting direction. The line head 120 has a recording region of a width which is equal to or greater than the width of the transported recording medium 111, and can record an image of one line on the transported recording medium 111 at once. After a recording medium is transported and scanning is performed once, the recording medium is brought back in a reverse direction to the transporting direction, and is transported again. Then, scanning is performed again, and recording may be performed by performing scanning two times or more in this manner. In this case, a position of the head in the direction perpendicular to the transporting direction is changed at an interval between scanning, and scanning is performed at the different position subsequently to the second scanning. Thus, recording resolution in the orthogonal direction may be increased. In this case, particularly, the above-described vibration of the head may be not performed. Even when the above-described vibration of the head is not performed, and the position of the head in the orthogonal direction is not changed, scanning is performed two times or more, and thus it is possible to increase the adhering amount of the reaction liquid or the ink to the recording medium. Scanning may be performed in accordance with an instruction. Scanning may be performed while the head is moved with respect to a recording medium fixed in a platen region. As such recording method, for example, the recording method disclosed in JP-A-2009-90635, and the like may be provided. Transportation of a recording medium, moving of a carriage having the head mounted therein, or the like causes a change of relative positions of the head and the recording medium.

In the example of FIG. 3, as an ink discharge method of the line head 120, a method in which droplets of an ink are discharged by using the vibration element (not illustrated) and by using pressure generated in an ink pressure chamber of the line head is employed. However, it is not limited thereto. Various methods such as a thermal ink jet method may be applied. In the thermal ink jet method, bubbles are generated by a heating element, pressure is applied, and thus an ink is discharged.

In the ink jet recording apparatus 200, for example, the ink compositions are discharged onto the recording medium by sequentially using the nozzle rows 121*a*, 121*b*, 121*c*, and 121*d*, and thus adhering is performed. In the second embodiment, the reaction liquid may be discharged from the nozzle row 121*a* on the uppermost stream side, and ink compositions of colors from the remaining nozzle rows 121*b*, 121*c*, and 121*d*. The configuration of the line head 120 is not limited to the above configuration. The line head 120 may be configured in such a manner that a plurality of line type heads in which one nozzle row is provided is arranged in parallel. In this case, a configuration in which a space between the line type heads is empty may be made.

According to the recording method of the second embodiment, in a case where the reaction liquid is discharged from the nozzle row 121*a*, the pH of the reaction liquid which contains a multivalent metal salt and water is set to be from 7 to 10, and thus it is possible to suppress occurrence of corrosion in the ink jet recording apparatus even when the reaction liquid floats in the ink jet recording apparatus 200 in a form of ink mist.

Other Configurations

Other configurations such as the recording medium, the recording conditions, and the reaction liquid are similar to those in the above-described first embodiment.

1.2.2. Ink Composition Adhering Process

In the ink composition adhering process, the ink composition is adhered to the recording region of a recording medium, after the reaction liquid adhering process. A method of adhering is not limited, but adhering is preferably performed by discharging the ink composition from the ink jet head. The above-described process of adhering the ink composition to the recording medium from the line type ink jet head is preferably applied as the ink composition adhering process, from a viewpoint of productivity in recording. As the ink composition adhering process, a process in which droplets of the ink composition are discharged from nozzles of an ink jet recording head, and the discharged droplets adhere to the above-described recording region of the recording medium, to which the reaction liquid has adhered is preferable. Thus, an image formed from the ink composition is formed on the recording region of the recording medium.

One form of the ink composition adhering process in the second embodiment is similar to the above-described ink composition adhering process in the first embodiment except that the ink composition is adhered to a recording medium from the line type ink jet head.

2. EXAMPLES

The embodiment of the invention will be specifically described below by using examples. However, the embodiment is not limited to only the examples.

2.1. Preparation of Ink Compositions

Preparation of Reaction Liquid

After components were mixed and stirred so as to have a mixing ratio in Table 1, the obtained mixture was filtered by using a membrane filter of 10 μm, and thereby reaction liquids (H1 to H12) were prepared. All numeric values in Table 1 indicate mass %. Ion exchange water was added so as to cause the total mass of each of the reaction liquids to be 100 mass %.

Preparation of Color Ink Composition

After components were mixed and stirred so as to have a mixing ratio in Table 1, the obtained mixture was filtered by using a membrane filter of 10 μm, and thereby a color ink composition (C1) was prepared. All numeric values in Table 1 indicate mass %. Ion exchange water was added so as to cause the total mass of the ink composition to be 100 mass %.

Composition and Physical Property of Ink Compositions

The composition and physical properties of each ink composition obtained in the above descriptions are shown in the following Table. 1.

TABLE 1

| Composition No. | | Reaction liquid | | | | | | |
|---|---|---|---|---|---|---|---|---|
| | | H1 | H2 | H3 | H4 | H5 | H6 | H7 |
| Cohesive agent | Calcium nitrate-tetrahydrate | 19 | 19 | 19 | 7.1 | 1.2 | 23.8 | 19 |
| | Calcium nitrate-heptahydrate | 0 | 0 | 0 | 0 | 0 | 0 | 0 |
| Coloring material | Cyan pigment | 0 | 0 | 0 | 0 | 0 | 0 | 0 |
| Surfactant | Silicon-based surfactant | 0.6 | 0.6 | 0.1 | 0.6 | 0.6 | 0.6 | 0.6 |
| Resin | Polyethylene resin | 0 | 0 | 0 | 0 | 0 | 0 | 0 |
| Solvent | 1,2-hexane diol | 3 | 3 | 3 | 3 | 3 | 3 | 3 |
| | Propylene amine | 15 | 15 | 15 | 15 | 20 | 13 | 15 |
| | Tripropanol glycol | 0.1 | 0.4 | 0.1 | 0.1 | 0.1 | 0.1 | 0.1 |
| | 0.01M sodium hydrate | 0 | 0 | 0 | 0 | 0 | 0 | 0 |
| | 0.1M acetic acid | 0 | 0 | 0 | 0 | 0 | 0 | 0.1 |

TABLE 1-continued

| | | | | | | | |
|---|---|---|---|---|---|---|---|
| Water | Remaining | Remaining | Remaining | Remaining | Remaining | Remaining | Remaining |
| Total | 100 | 100 | 100 | 100 | 100 | 100 | 100 |
| concentration of cohesive agent (mol/L) | 0.8 | 0.8 | 0.8 | 0.3 | 0.05 | 1 | 0.8 |
| pH | 8 | 9 | 8 | 8 | 8 | 8 | 3 |
| Viscosity (mPa · s 20° C.) | 4 | 4 | 4 | 4 | 4 | 4 | 4 |
| Surface tension (mN/m) | 25 | 25 | 35 | 25 | 25 | 25 | 25 |

| | | Reaction liquid | | | | | Color ink |
|---|---|---|---|---|---|---|---|
| Composition No. | | H8 | H9 | H10 | H11 | H12 | C1 |
| Cohesive agent | Calcium nitrate-tetrahydrate | 19 | 19 | 19 | 19 | 0 | 0 |
| | Calcium nitrate-heptahydrate | 0 | 0 | 0 | 0 | 19 | 0 |
| Coloring material | Cyan pigment | 0 | 0 | 0 | 0 | 0 | 4 |
| Surfactant | Silicon-based surfactant | 0.6 | 0.6 | 0.6 | 0 | 0.6 | 0.6 |
| Resin | Polyethylene resin | 0 | 0 | 0 | 0 | 0 | 1 |
| Solvent | 1,2-hexane diol | 3 | 3 | 3 | 3 | 3 | 3 |
| | Propylene amine | 15 | 0 | 30 | 15 | 15 | 10 |
| | Tripropanol glycol | 0 | 0.1 | 0.1 | 0.1 | 0.1 | 0.1 |
| | 0.01M sodium hydrate | 0.01 | 0 | 0 | 0 | 0 | 0 |
| | 0.1M acetic acid | 0 | 0 | 0 | 0 | 0 | 0 |
| | Water | Remaining | Remaining | Remaining | Remaining | Remaining | Remaining |
| Total | | 100 | 100 | 100 | 100 | 100 | 100 |
| concentration of cohesive agent (mol/L) | | 0.8 | 0.8 | 0.8 | 0.8 | 0.8 | — |
| pH | | 12 | 8 | 8 | 8 | 8 | — |
| Viscosity (mPa · s 20° C.) | | 4 | 2 | 15 | 4 | 4 | — |
| Surface tension (mN/m) | | 25 | 25 | 25 | 50 | 25 | — |

Components which are shown in Table 1 other than the names of compounds are as follows.

Coloring Material

Cyan pigment (C.I. Pigment Blue 15:3)

Surfactant

Silicon-based surfactant (merchandise name "BYK-348", manufactured by BYK-Chemie Japan Corporation)

Resin

Polyethylene resin (merchandise name "AQUASER507", manufactured by BYK-Chemie Japan Corporation, average particle diameter: 50 nm, Tg: 60° C.)

2.2. Recording Method

An apparatus obtained by modifying SurePressL-4033A (manufactured by Seiko Epson Corp.) was used as Recording apparatus 1. Main modifications are as follows: modification in which SurePressL-4033A was modified so as to be a line printer in which a line head was disposed and fixed, and recording was performed while a recording medium was transported; and modification in which a similar line head was disposed on an upstream side of an ink composition head in the transporting direction of a recording medium, and the disposed line head was used as a reaction liquid head. The head was configured as a line head in which a plurality of head units (distance between nozzles in a width direction of a recording medium: 600 dpi, number of nozzles: 600) are arranged in the width direction of the recording medium. As the head, a head which used an epoxy adhesive (merchandise name "EP330", manufactured by Cemedine Co., Ltd.) in manufacturing (bonding) of a passage through which an ink in the head passed was used.

An ink composition head was filled with a color ink (C1), and the reaction liquid head was filled with any type of the reaction liquid. Recording was performed by one path (one scanning) while a recording medium is transported. A platen under the head did not operate a heater, and a surface temperature of the recording medium on the platen was set to 25° C. After the ink composition adhering process, an after-heater disposed on a downstream side of the platen heated the recording medium to 50° C. As the recording medium, a roll-like recording medium (merchandise name "CAST 73", manufactured by Oji Paper Co., Ltd.) was used. While the roll-like recording medium was transported, recording was performed. Recording conditions for the ink composition and recording conditions for the reaction liquid were as follows.

Recording Conditions for Ink Composition

Recording resolution (density of discharged droplet): 600×600 dpi

Ink adhering amount: 7 mg/inch$^2$

Recording Conditions for Reaction Liquid

Recording resolution: being shown in Table 2

Reaction liquid adhering amount: about 2.2 mg/inch$^2$

Dot size (liquid amount per discharged droplet): being shown in Table 2

Wait between the reaction liquid and the ink:

In an example in Tables 2 to 3, in which wait between the reaction liquid and the ink was 5 seconds, a transporting speed of a recording medium was set to 7 m/minute, and a time interval from completion of adhering of the reaction liquid until a start of adhering of the ink was set to 5 seconds by adjusting a distance between the ink composition head and the reaction liquid head. The distance was about 60 cm.

In an example in Table 3, in which the wait between the reaction liquid and the ink was 30 seconds, the transporting speed of a recording medium was delayed from that in the example of 5 seconds, and set to about 1.2 m/minute. Because the recording resolution of a record was not changed, control for lowering a discharge frequency was also performed.

Recording Apparatus 2

Recording apparatus 2 was similar to Recording apparatus 1 except that as the reaction liquid head, a head manufactured by using a silicone-based adhesive (merchandise name "TSR1512", manufactured by Momentive Performance Material Inc.) instead of the epoxy-based adhesive was used.

Recording Apparatus 3

An apparatus obtained by modifying a serial type printer PX-H8000 (manufactured by Seiko Epson Corp.) was used as Recording apparatus 3. Main modification is that two head units which were used in the recording apparatus 1 were disposed in parallel in a direction of moving a carriage were used as the carriage. One head unit was filled with the ink composition, and another one head unit was filled with the reaction liquid. In Recording apparatus 3, droplet discharge (scanning) with moving of the carriage and sub-scanning in which a recording medium is moved in a direction intersecting with the direction of moving the carriage were performed many times, so as to perform recording. Firstly, scanning of discharging only the reaction liquid was performed, and stop time was provided so as to set wait between the reaction liquids to 5 seconds. Then, the ink composition was discharged in the next scanning, and sub-scanning (transporting) was subjected to the recording medium at a predetermined interval. Recording was performed by repeating the above procedures.

2.3. Evaluation Test

Member Attack Property 0.3 g of a sample piece was prepared for each example. The sample piece was obtained by curing a material the same as an adhesive used in the head of the recording apparatus. The prepared sample piece was completely dipped in a glass container into which the reaction liquid was put, and the glass container was closed. The glass container was left for 20 days under an environment of 60° C. After being left, an adhesive piece was extracted, and the reaction liquid of the adhesive piece was washed off. Then, a weight of the adhesive piece was measured. A swelling ratio of the adhesive piece was calculated by using the following expression, and was evaluated. Evaluation criteria are as follows. If the swelling ratio is low, a component such as the head, which is bonded by using the adhesive is peeled off when a printer is being used, and thus deterioration or damage of the head is caused. Accordingly, it is preferable that the swelling ratio is set not to cause the deterioration or damage of the head. The swelling ratio relates to a long-term head durability.

$$\text{Swelling ratio (\%)}=\{(\text{weight after an input-weight before the input})/\text{weight before the input}\}\times 100$$

Evaluation Criteria

A: swelling ratio is smaller than 30%

B: swelling ratio is equal to or greater than 30%

In-Apparatus Corrosion

An iron plate of 1 cm×1 cm was bonded to a side surface of the head unit in the vicinity of the center of the line head. A test pattern of 3 cm×3 cm was recorded on a recording medium so as to cause the test pattern to be arranged vertically and horizontally at an interval of 1 cm, and a recording set for continuously performing recording for 60 minutes was performed 8 times a day. Such a procedure was performed totally for 100 days. The recording region of the recording medium in the width direction thereof was set to about 20 cm. After the procedure was completed, the plate was separated from the head, and was washed with water and dried. Then, the surface of the plate was visually observed. In a case of using Recording apparatus 3, a similar test pattern was recorded on a similar recording medium by performing scanning and sub-scanning many times. A similar plate was bonded to a side surface of the reaction liquid head unit. Evaluation criteria are as follows.

Evaluation Criteria

A: metallic glossy feeling is not changed in comparison to that before a test.

B: metallic glossy feeling is deteriorated, but rust does not occur.

C: occurrence of rust is viewed.

Solid Image Quality

Recording was performed under conditions which were the same as those for the in-apparatus corrosion, and a pattern was visually observed. Visual observation was used for determining whether or not colors in the pattern were ununiformly viewed due to bleeding.

Evaluation Criteria

A: ununiform colors are not viewed if an observer is separated from the pattern at a distance of 30 cm. The record is very good.

B: ununiform colors are slightly viewed if an observer is separated from the pattern at a distance of 30 cm, but are not viewed if the observer is separated at a distance of 100 cm. The record is good.

C: ununiform colors are viewed even if an observer is separated from the pattern at a distance of 100 cm. The record is poor.

Printed Matter Durability

Regarding a record obtained for evaluating solid image quality, durability was evaluated by using a Gakushin-type color rubbing fastness tester (device name "AB-301", manufactured by TESTER SANGYO CO., Ltd.). Specifically, the recording region in which an image was recorded was rubbed with a friction object having an attached white cotton fabric (based on JIS L 0803). The rubbing was repeated 100 times with a load of 500 g.

Evaluation Criteria

A: The white cotton fabric is contaminated, but an image is not peeled off. The record is very good.

B: it is confirmed that an image is slightly peeled off (so as to be smaller than 20%). The record is good.

C: an image is significantly peeled off (20% or greater). The record is poor.

Fluctuation of Discharged Liquid (Long-Term Head Durability)

Recording similar to that in evaluation for the in-apparatus corrosion was performed totally for 200 days. An average droplet amount (mass) per droplet of the reaction liquid discharged from one head in the vicinity of the center was measured when recording on the first day was ended, and when recording on the final day was ended. The average droplet amount was measured in such a manner that the total liquid amount of the continuously-discharged liquid was measured, and the total liquid amount was divided by the number of times of discharge. A change ratio (%) of the average droplet amount on the final day to the average droplet amount on the first day was calculated. Evaluation criteria are as follows.

Evaluation Criteria

A: the change ratio of the average droplet amount is smaller than 1%.

B: the change ratio of the average droplet amount is equal to or greater than 1% and smaller than 5%.

C: the change ratio of the average droplet amount is equal to or greater than 5% and smaller than 10%.

D: the change ratio of the average droplet amount is equal to or greater than 10%.

2.4. Evaluation Results

Examples 1 to 12, Comparative Examples 1 to 3, and Reference Examples 1 and 2 were performed based on the recording method and the evaluation test. Recording methods and Evaluation results of Examples 1 to 12, Comparative Examples 1 to 3, and Reference Examples 1 and 2 are shown in the following Tables 2 and 3.

TABLE 2

| | | Example 1 | Example 2 | Example 3 | Example 4 | Example 5 | Example 6 |
|---|---|---|---|---|---|---|---|
| Reaction liquid characteristics | Reaction liquid composite | H1 | H2 | H3 | H4 | H12 | H5 |
| | Concentration of reagent (mol/L) | 0.8 | 0.8 | 0.8 | 0.3 | 0.8 | 0.05 |
| | pH | 8 | 9 | 8 | 8 | 8 | 8 |
| | Viscosity (mPa · s 20° C.) | 4 | 4 | 4 | 4 | 4 | 4 |
| | Surface tension (mN/m) | 25 | 25 | 35 | 25 | 25 | 25 |
| Recording conditions | Recording resolution (dpi) | 600 × 600 | 600 × 600 | 600 × 600 | 600 × 600 | 600 × 600 | 600 × 600 |
| | Dot side (ng/dot) | 6 | 6 | 6 | 6 | 6 | 6 |
| | Wait between reaction liquid and ink (seconds) | 5 | 5 | 5 | 5 | 5 | 5 |
| | Recording apparatus | Recording apparatus 1 | Recording apparatus 1 | Recording apparatus 1 | Recording apparatus 1 | Recording apparatus 1 | Recording apparatus 1 |
| Evaluation results | Member attack property | A | A | A | A | A | A |
| | In-apparatus corrosion | A | A | A | A | A | A |
| | Solid image | A | A | B | B | B | C |
| | Printed matter durability | A | A | A | A | A | A |
| | Fluctuation of discharged liquid | A | A | A | A | A | A |

| | | Example 7 | Comparative Example 1 | Comparative Example 2 | Comparative Example 3 |
|---|---|---|---|---|---|
| Reaction liquid characteristics | Reaction liquid composite | H6 | H7 | H8 | H7 |
| | Concentration of reagent (mol/L) | 1 | 0.8 | 0.8 | 0.8 |
| | pH | 8 | 3 | 12 | 3 |
| | Viscosity (mPa · s 20° C.) | 4 | 4 | 4 | 4 |
| | Surface tension (mN/m) | 25 | 25 | 25 | 25 |
| Recording conditions | Recording resolution (dpi) | 600 × 600 | 600 × 600 | 600 × 600 | 300 × 600 |
| | Dot side (ng/dot) | 6 | 6 | 6 | 12 |
| | Wait between reaction liquid and ink (seconds) | 5 | 5 | 5 | 5 |
| | Recording apparatus | Recording apparatus 1 | Recording apparatus 1 | Recording apparatus 1 | Recording apparatus 1 |
| Evaluation results | Member attack property | A | C | C | C |
| | In-apparatus corrosion | A | C | A | C |
| | Solid image | A | A | A | C |
| | Printed matter durability | C | A | A | A |
| | Fluctuation of discharged liquid | A | C | C | B |

TABLE 3

| | | Example 8 | Example 9 | Example 10 | Example 11 | Example 12 | Reference Example 1 | Reference Example 2 |
|---|---|---|---|---|---|---|---|---|
| Reaction liquid characteristics | Reaction liquid composite | H9 | H10 | H11 | H1 | H1 | H7 | H7 |
| | Concentration of reagent (mol/L) | 0.8 | 0.8 | 0.8 | 0.8 | 0.8 | 0.8 | 0.8 |
| | pH | 8 | 8 | 8 | 8 | 8 | 3 | 3 |
| | Viscosity (mPa · s 20° C.) | 2 | 15 | 4 | 4 | 4 | 4 | 4 |
| | Surface tension (mN/m) | 25 | 25 | 50 | 25 | 25 | 25 | 25 |
| Recording conditions | Recording resolution (dpi) | 600 × 600 | 600 × 600 | 600 × 600 | 300 × 600 | 600 × 600 | 600 × 600 | 600 × 600 |
| | Dot side (ng/dot) | 6 | 6 | 6 | 12 | 6 | 6 | 6 |
| | Wait between reaction liquid and ink (seconds) | 5 | 5 | 5 | 5 | 30 | 5 | 5 |

TABLE 3-continued

| | | Example 8 | Example 9 | Example 10 | Example 11 | Example 12 | Reference Example 1 | Reference Example 2 |
|---|---|---|---|---|---|---|---|---|
| | Recording apparatus | Recording apparatus 1 | Recording apparatus 1 | Recording apparatus 1 | Recording apparatus 1 | Recording apparatus 1 | Recording apparatus 2 | Recording apparatus 3 |
| Evaluation results | Member attack property | A | A | A | A | A | A | C |
| | In-apparatus corrosion | A | A | A | AA | AA | C | AA |
| | Solid image | C | C | C | C | C | A | A |
| | Printed matter durability | A | A | A | A | A | A | A |
| | Fluctuation of discharged liquid | C | C | B | A | A | CC | C |

According to the recording methods of Example 1 to 12 shown in Tables 2 and 3, it was determined that the member attack property and the in-apparatus corrosion are good. In Example 6, since concentration of the reagent in the reaction liquid is low, reaction of the component in the ink composition, and the reagent insufficiently occurs, and thus a tendency that image quality of a solid image was deteriorated was confirmed. In Example 7, since concentration of the reagent in the reaction liquid is high, fixing of the reagent to the recording medium was difficult, and printed matter durability is poor.

In Examples 8 to 10, an influence of viscosity or surface tension of the reaction liquid caused stable discharge to be impossible, and caused a nozzle which did not perform discharging to appear in the process of recording. The nozzle which did not perform discharging suddenly appears in comparison to time when the test pattern was observed. Thus, it is predicted that the average droplet amount has been changed due to such a nozzle. Accordingly, it is considered that, in Examples 8 to 10, evaluation is not sufficient only by evaluation for fluctuation of the discharged amount.

In Example 11, since the dot size of the reaction liquid is large, a tendency that uniform coating was impossible and image quality of a solid image was deteriorated was confirmed. Even though the recording resolution is lowered, and the reaction liquid adhering amount is not changed, a tendency that solid image quality is deteriorated is viewed. If droplet density is lowered by using large droplets and adhering is performed, it is predicted that uniform coating with the reaction liquid is difficult, and insufficient contact with the reaction liquid in an ink dot of an image, and insufficient reaction occur. Becoming mist was difficult and in-apparatus contamination was reduced. Accordingly, it was recognized that the invention was particularly useful in a case of small dots in which high image quality was obtained, but deformation to be mist easily occurred.

In Example 12, since the wait between the reaction liquid and the ink was 30 seconds, a tendency that the reaction liquid is permeated in the recording medium, and solid image quality was deteriorated was confirmed. Consequently, because a time interval of the discharge became long, mist was easily diffused in a wide range, and staying of the mist in the vicinity of the head was difficult, a tendency of reducing the in-apparatus contamination (corrosion) was viewed. As the transporting speed of a recording medium became faster, productivity of a record was preferably improved. However, it was understood that an amount of the mist was increased and the in-apparatus contamination easily became a problem. Thus, it was recognized that the invention was particularly useful in a case where the wait between the reaction liquid and the ink was short and the amount of the mist was easily increased.

The short wait between the reaction liquid and the ink has a tendency that the image quality of a solid image becomes good. However, it is predicted that, as time goes, the reaction liquid is permeated into the recording medium, and the reaction of the reagent with the component in the ink composition is difficult. The wait between the reaction liquid and the ink is changed depending on the transporting speed, a distance between the heads, and the like. However, the short wait between the reaction liquid and the ink is preferable from a point of good image quality of a solid image.

In Comparative Example 1 and Comparative Example 3, a pH of the reaction liquid was smaller than 7, and thus it was confirmed that a record was poor from a point of the member attack property and the in-apparatus corrosion, and fluctuation of discharge characteristics occurred by deterioration of the head. In Comparative Example 3, the dot size of the reaction liquid was large, and thus the fluctuation of discharge characteristics had a tendency of reduction. Thus, it was recognized that the invention was particularly useful in a case where the dot size of the reaction liquid was desired to be small, and the image quality was desired to be improved more. In Comparative Example 2, the pH of the reaction liquid was greater than 10, and thus it was confirmed that a record was poor from a point of the member attack property, and fluctuation of discharge characteristics occurred by deterioration of the head.

Reference Example 1 is an example of using a reaction liquid of a pH (pH=3) which is smaller than 7, and Recording apparatus 2. In Recording apparatus 2, a head manufactured by using a silicone-based adhesive (merchandise name "TSR1512", manufactured by Momentive Performance Material Inc.) was used. However, it was recognized that good member attack property was obtained even when an acidic reaction liquid was used. It is predicted that the discharged amount of droplet fluctuates for a long time since the durability of the head is deteriorated.

Reference Example 2 is an example of using a reaction liquid of a pH (pH=3) which is smaller than 7, and Recording apparatus 3. In Recording apparatus 3, the in-apparatus corrosion was reduced because the number of head units is small, a period when the reaction liquid was not discharged during an interval of scanning was present, and mist was diffused so as not to stay in the vicinity of the head, or because a structure in which the head is moved was provided. However, the recording rate is significantly delayed. Accordingly, it was recognized that the invention was particularly useful in a case where high speed recording was performed by a line printer including a line type ink head.

The invention is not limited to the above-described embodiment, and various modifications may be applied. For example, the invention includes a configuration (for example, configuration having the same function, the same method, and the same results, or configuration having the same object and the same effects) which is substantially the same as the configuration described in the embodiment. The invention includes a configuration obtained by substituting a component which is not fundamental component in the configuration described in the embodiment. The invention includes a configuration which can exhibit the same advantages effects the same as those of the configuration described in the embodiment, or can achieve the same object. The invention includes a configuration obtained by adding well-known technologies to the configuration described in the embodiment.

What is claimed is:

1. A recording method comprising:

adhering an ink composition including a pigment colorant to a recording medium to color the recording medium; and adhering a reaction liquid to the recording medium, the reaction liquid containing water and a reagent for aggregating or thickening components of the ink composition, and having a pH of 7 to 10, wherein the reaction liquid does not include a colorant to color the recording medium, the reaction liquid includes a pH adjuster that adjusts the pH of the reaction liquid from a pH that is acidic to a pH that is in a range of neutral to alkaline, in the adhering of the reaction liquid, the reaction liquid is discharged from an ink jet head so as to adhere to the recording medium, and a mass of one droplet (1 dot) of the discharged reaction liquid is equal to or less than 15 ng, in the adhering of the reaction liquid an epoxy-based adhesive is used for at least a portion of a reaction liquid passage for supplying the reaction liquid to the ink jet head, and a member in contact with the reaction liquid in the ink jet head, the epoxy-based adhesive includes a curing agent and a main agent that contains a compound having an epoxy group, the main agent being cured by the curing agent, and the curing agent including at least one of an amine, an amide, an imidazole, and a polyercaptan, and a maximum adhering amount of the ink composition to the recording medium is 5 to 20 mg/inch$^2$.

2. The recording method according to claim 1, wherein a surface tension of the reaction liquid is from 18 mN/m to 35 mN/m at 20° C.

3. The recording method according to claim 1, wherein a concentration of the reagent in the reaction liquid is from 0.05 mol/L to 0.9 mol/L.

4. The recording method according to claim 1, wherein a viscosity of the reaction liquid is from 2 mPa·s to 10 mPa·s at 20° C.

5. The recording method according to claim 1, wherein in the adhering of the reaction liquid, the mass of the one droplet (1 dot) of the discharged reaction liquid is equal to or less than 10 ng.

6. The recording method according to claim 1, wherein a scanning speed in the adhering of the reaction liquid is equal to or higher than 5 m/minute.

7. The recording method according to claim 1, wherein adhering of the ink composition is started within 20 seconds from when adhering of the reaction liquid is completed.

8. A recording apparatus which is used for performing the recording method according to claim 1, and comprises an ink jet head.

9. The recording method according to claim 1, wherein the pH of the reaction liquid is in the range of 7.5 to 9.

10. The recording method according to claim 1, wherein the pH of the reaction liquid is in the range of 8 to 9.

11. The recording method according to claim 1, wherein the reagent is a material that indicates acidity.

12. The recording method according to claim 1, wherein a content of the reagent is in the range of 0.5 to 20 mass % with respect to a total mass of the reaction liquid.

13. The recording method according to claim 1, wherein the ink composition includes a resin particle.

14. The recording method according to claim 1, wherein the pH adjuster is a basic material.

15. The recording method according to claim 1, wherein the ink jet head is a line-type ink jet head.

16. The recording method according to claim 15, wherein the line-type ink jet head is a head in which a length of the head in a longitudinal direction that intersects with a transport direction is equal to or greater than a length of a recording region of the recording medium in the longitudinal direction, and a number of times of performing a scanning with the line-type ink jet head is one.

17. The recording method according to claim 1, wherein the reagent is a multivalent metal salt, and the multivalent metal salt is a salt of a strong acid and an alkali.

18. The recording method according to claim 1, wherein in the adhering of the reaction liquid, the mass of the one droplet (1 dot) of the discharged reaction liquid is in the range of 1 to 10 ng.

19. The recording method according to claim 1, wherein a maximum adhering amount of the reaction liquid to the recording region is 0.2 mg/inch$^2$ to 2 mg/inch$^2$.

20. The recording method according to claim 1, wherein the reagent includes at least one of a multivalent metal salt, an organic acid, a cationic resin, and a cationic surfactant.

21. The recording method according to claim 1, wherein the pH adjuster includes at least one of sodium hydroxide, potassium hydroxide, calcium hydroxide, sodium carbonate, ammonia, triethanol amine, and triisopropanol amine.

22. The recording method according to claim 1, wherein the recording medium is an ink low-absorbable recording medium, or an ink non-absorbable recording medium.

23. The recording method according to claim 1, wherein a mass of one droplet (1 dot) of the discharged reaction liquid is 6 to 15 ng.

24. The recording method according to claim 1, wherein a surface tension of the reaction liquid is from 18 mN/m to 25 mN/m at 20° C.

25. The recording method according to claim 1, wherein the ink composition is adhered to the recording medium after the reaction liquid is adhered to the recording medium, and an amount of time that elapses between adhering of the reaction liquid and adhering of the ink composition is in the range of 1 seconds to 30 seconds.

* * * * *